US005287252A

United States Patent [19]

Caruso

[11] Patent Number: 5,287,252

[45] Date of Patent: Feb. 15, 1994

[54] ADJUSTABLE ILLUMINATED REFRIGERATOR SHELF

[75] Inventor: Jerome Caruso, Lake Forest, Ill.

[73] Assignee: Sub-Zero Freezer Company, Inc., Madison, Wis.

[21] Appl. No.: 4,757

[22] Filed: Jan. 14, 1993

[51] Int. Cl.[5] ..... F25D 27/00

[52] U.S. Cl. ..... 362/92; 362/234; 362/396; 312/236; 312/223.5

[58] Field of Search ..... 362/92, 94, 125, 133, 362/154, 234, 253, 396, 432; 312/223.5, 236

[56] References Cited

U.S. PATENT DOCUMENTS

| | | | |
|---|---|---|---|
| 2,442,921 | 6/1948 | Drake | 362/92 |
| 2,995,649 | 8/1961 | Cyrus | 362/92 |
| 3,172,715 | 3/1965 | Powder | 312/298 |
| 3,178,832 | 4/1965 | Barroero | 34/237 |
| 3,352,431 | 11/1967 | Smith | 211/208 |
| 3,360,322 | 12/1967 | Hanifan | 312/312 |
| 3,610,174 | 10/1971 | Kesling | 312/312 |
| 3,612,848 | 10/1971 | Koch | 362/92 |
| 3,690,744 | 9/1972 | Squire | 312/273 |
| 3,814,492 | 6/1974 | Jacobs | 312/273 |
| 3,859,932 | 1/1975 | Armstrong et al. | 108/75 |
| 4,154,492 | 5/1979 | Dunning | 362/133 |
| 4,528,825 | 7/1985 | Khan | 62/411 |
| 4,923,260 | 5/1990 | Poulsen | 312/408 |
| 4,936,641 | 6/1990 | Bussan et al. | 312/408 |
| 5,016,146 | 5/1991 | Kaspar | 362/92 |
| 5,034,861 | 7/1991 | Sklenak et al. | 362/92 |

*Primary Examiner*—Stephen F. Husar
*Attorney, Agent, or Firm*—Foley & Lardner

[57] ABSTRACT

An adjustable shelf assembly for illuminating the interior of a refrigerator, the refrigerator including a cabinet and a back wall having vertical electrically conductive standards having a number of slots, the shelf assembly including a pair of brackets mounted on the standards, an electrically conductive strip mounted in each bracket, each strip including a formed tab for engaging the slots in the standards, a panel supported between the brackets and a light assembly mounted on the front edge of the panel in electrical engagement with said strips for illuminating the space beneath the panel.

9 Claims, 4 Drawing Sheets

FIG. 6
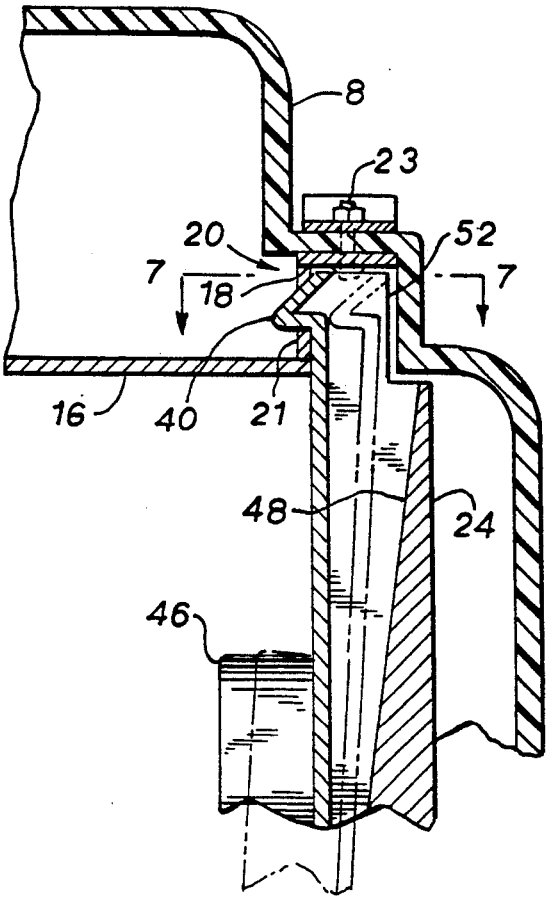
FIG. 7
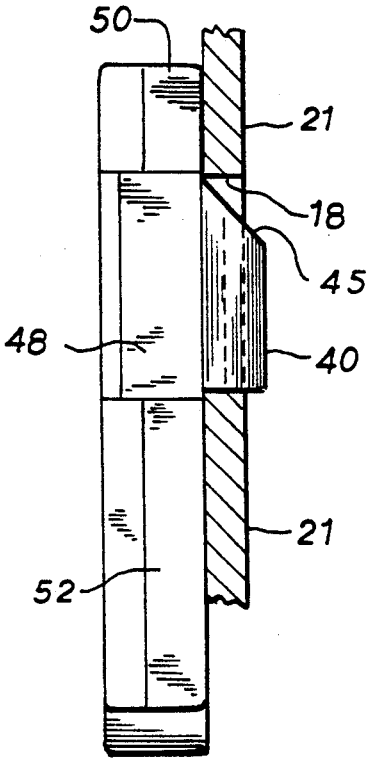
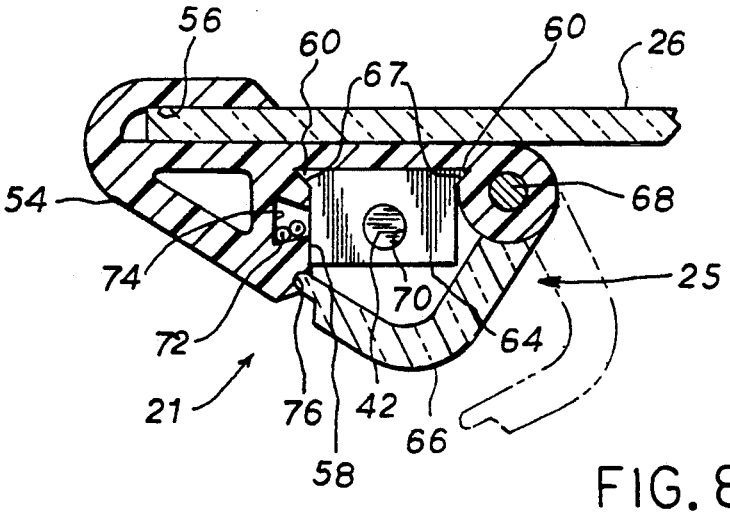
FIG. 8

ADJUSTABLE ILLUMINATED REFRIGERATOR SHELF

FIELD OF THE INVENTION

The present invention relates to an adjustable shelf for a refrigerator and more particularly to an adjustable shelf having a self-lighting system for illuminating the interior of the refrigerator.

BACKGROUND OF THE INVENTION

The illumination of the interior of refrigerators has been a problem due to the constant change of the position of food items on the shelves within the refrigerator. Due to their continuous rearrangement on the shelves of the refrigerator the light is often blocked, producing shade spots in the refrigerator. Various solutions to this problem have been provided by systems such as that shown in U.S. Pat. No. 5,034,861, entitled "Shelf Track Lighting," issued on Jul. 23, 1992, to John S. Sklenak, et al. In this system the shelves are movable on electrically conductive standards which provide electrical communication to a light fixture positioned in the center of the bottom of the glass shelf. The light from this type of fixture thus provides illumination in the area below the shelf. Similar systems are shown in U.S. Pat. No. 5,016,146, entitled "Refrigerator Light Assembly With Bulb Insulating And protective Sleeve," issued on May 14, 1991, to Melvin Kaspar, and U.S. Pat. No. 3,612,848, entitled "Refrigerator Light Structure," issued on Oct. 12, 1971, to Alan J. Koch, et al.

SUMMARY OF THE PRESENT INVENTION

The present invention relates to a movable or adjustable shelf which is provided with a light fixture on the front edge of the shelf to illuminate the area beneath and rearwardly of the shelf. Each shelf generally includes a glass panel having a support bracket mounted on each side of the panel with the light assembly mounted on the front edge of the panel. The shelf is supported within the refrigerator in reveals or recesses formed by electrically conductive standards provided on either side of the back wall of the cabinet with notches provided on the inside walls of the standards, such that the recesses appear as slotless recesses. The shelves can be inserted straight into the refrigerator without tilting and snap fitted into the notches located on the sides of the standards. The shelves are so designed that they can be quickly and easily adjusted upwardly to change the position of each shelf without removing the shelf from the back wall. The shelf brackets include guides or flanges which are aligned in the recesses in the back of the refrigerator to prevent side to side tilting of the shelf.

One of the primary features of the invention is the provision of a light assembly on the front edge of the shelf panel wherein the light is directed downwardly and rearwardly in the refrigerator and thus shielded from the user's eye.

A further feature of the invention is the use of electrically conductive standards to support the shelves as well as providing an electrical connection for the shelf lights when the shelf is snapped into position in the standards.

Each shelf generally includes a pair of brackets mounted on the side edges of a glass panel and a light assembly mounted on the front edge of the panel. Each bracket includes a guide on one end which is aligned in the recesses in the back wall of the refrigerator. The brackets are also provided with release tabs which engage slots or notches in the inside walls of the standard. The tabs are electrically connected to the conductive strips provided in the recesses on the inside of each of the shelf brackets. The glass shelf is supported on the brackets and an aluminum extrusion is mounted on the front edge of the shelf for supporting a number of low voltage sockets which are enclosed within a diffuser mounted along the underside of the extrusion. Electrical communication to the sockets is provided through a pin on the end of the metallic strips in the brackets which is inserted into the sockets in the extrusion.

Other principal features and advantages of the invention will become apparent to those skilled in the art upon review of the following drawings, the detailed description and the appended claims.

BRIEF DESCRIPTION OF THE DRAWINGS

FIG. 6 is an enlarged view of connection of the bracket to the refrigerator;

FIG. 7 is a view taken on line 7—7 of FIG. 6; and

FIG. 8 is a view taken on line 8—8 of FIG. 1 showing the connection of the light fixture to the standard.

Figure 1:
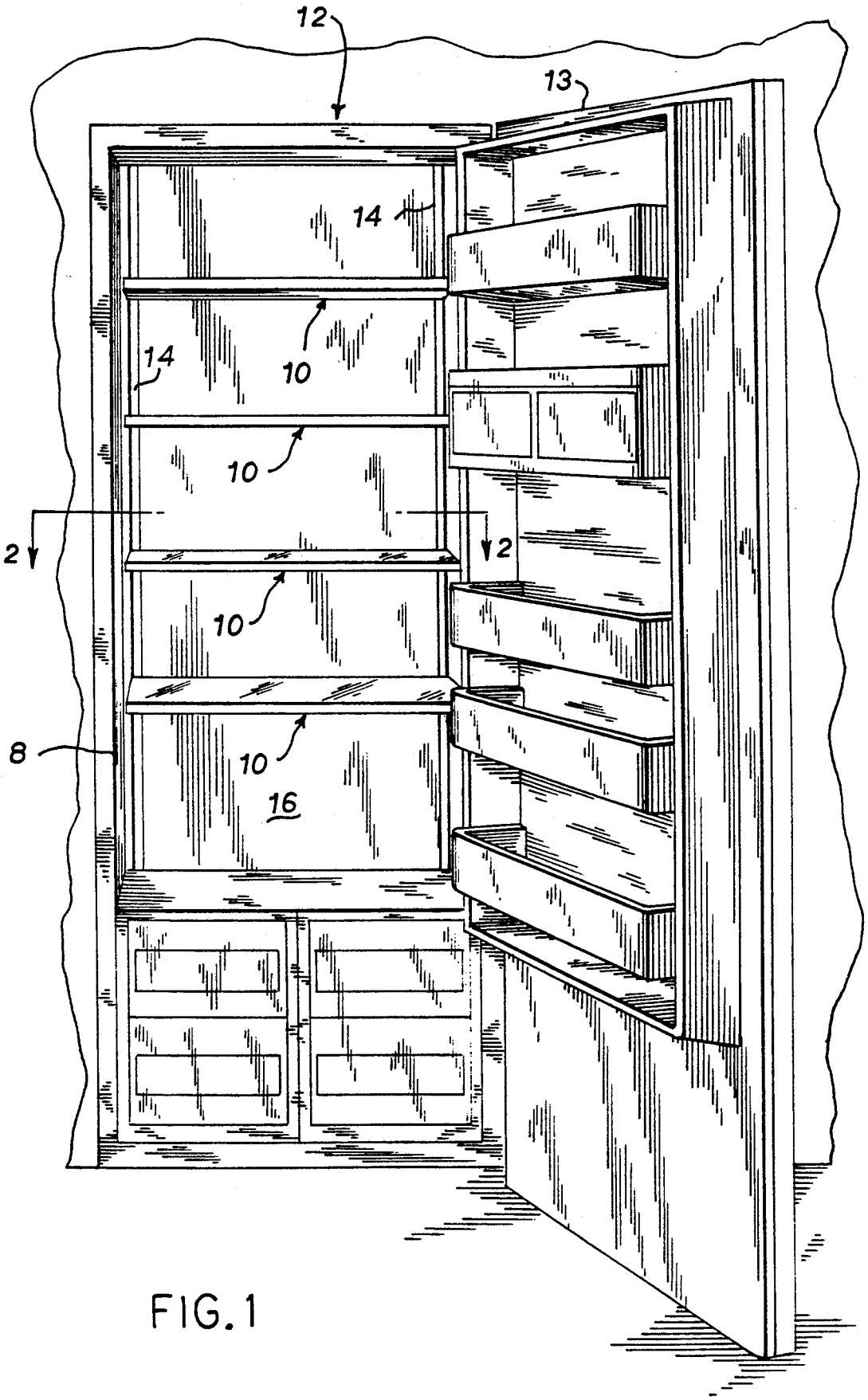
FIG. 1 is a perspective view of a refrigerator showing the arrangement of the shelves within the refrigerator.

Before explaining at least one embodiment of the invention in detail it is to be understood that the invention is not limited in its application to the details of construction and the arrangement of the components set forth in the following description or illustrated in the drawings. The invention is capable of other embodiments or being practiced or carried out in various ways. Also, it is to be understood that the phraseology and terminology employed herein is for the purpose of description and should not be regarded as limiting.

DETAILED DESCRIPTION OF THE PREFERRED EMBODIMENTS

The adjustable shelves 10 according to the present invention as shown in FIG. 1 are mounted in the cabinet 8 of a refrigerator 12 having a door 13. The shelves 10 are supported in vertical steel standards 20 which form reveals or recesses 14 on each side of the back wall 16 of the refrigerator. The standards 20 on each side of the back wall 16 are provided with a number of slots 18 or openings along the inner walls 21 of the standards 20. The edges of the back wall 16 are seated on the edges of the inner walls 21. The slots 18 provided in the inner walls 21 of each of the standards 20 are not visible from the front of the refrigerator when the door is open. The standards 20 are secured to the cabinet by bolts 23. Each of the shelves 10 includes a light assembly 25 in the front edge of the shelves which shines downwardly and rearwardly to light the space immediately below each shelf. With this arrangement the items on the shelves cannot block the light thus providing full illumination of the items on the lower shelf.

Figure 2:
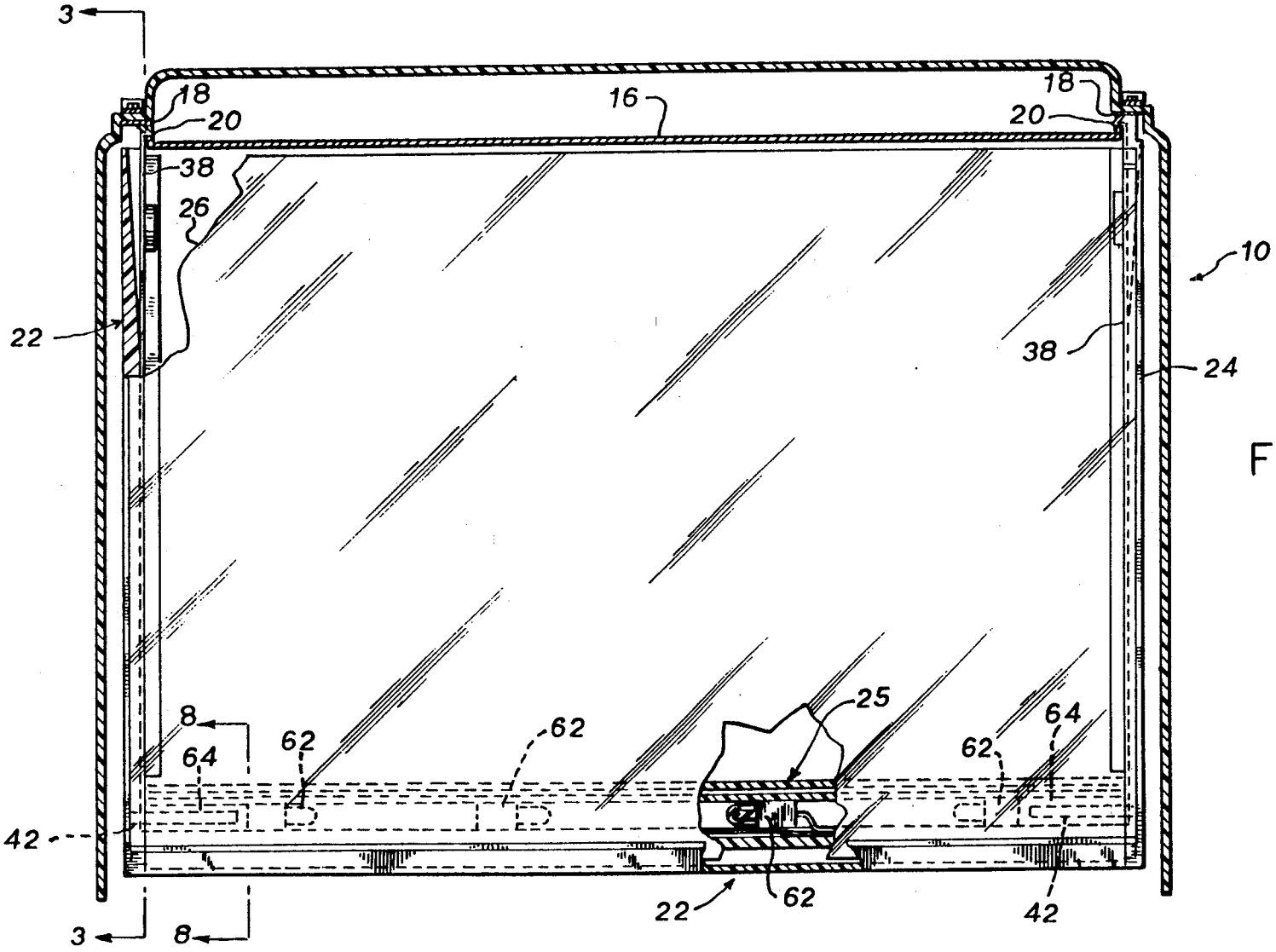
FIG. 2 is a view taken on line 2—2 of FIG. 1 showing one of the shelves mounted in the refrigerator.

Each of the shelves 10 as shown in FIG. 2, generally includes a pair of brackets 22 and 24 for supporting a glass panel 26. Each of the brackets 22 and 24 includes an electrically conductive strip 38 having a tab 40 formed at the end of each strip. Each of the tabs 40 engages one of the slots 18 provided in the inner wall 21 to provide an electrical connection between the standards 20 and the light assembly 22.

Figure 4:
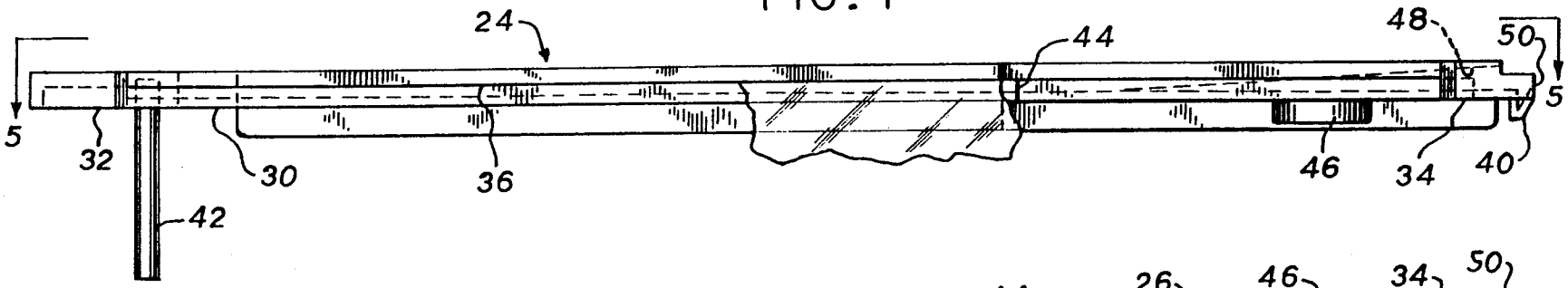
FIG. 4 is a top view of the side wall bracket.
Figure 3:
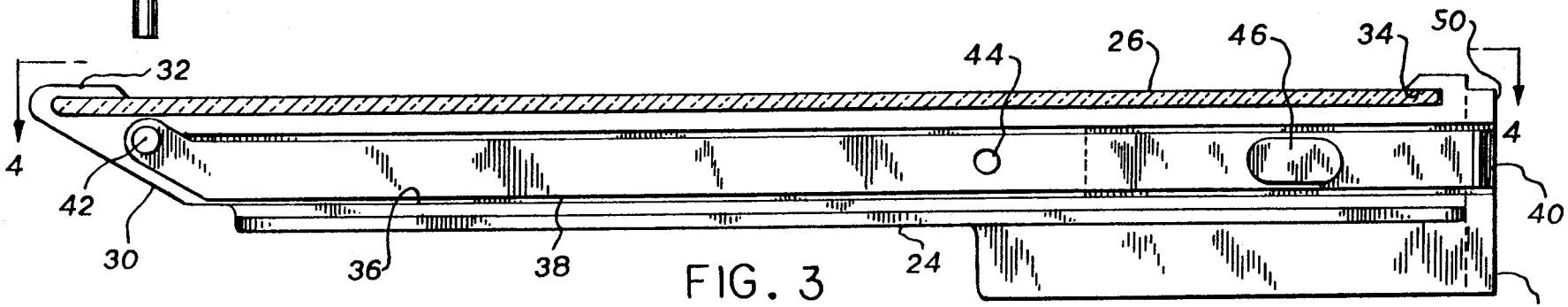
FIG. 3 is a view taken on line 3—3 of FIG. 2 showing one of the side wall brackets.
Figure 5:
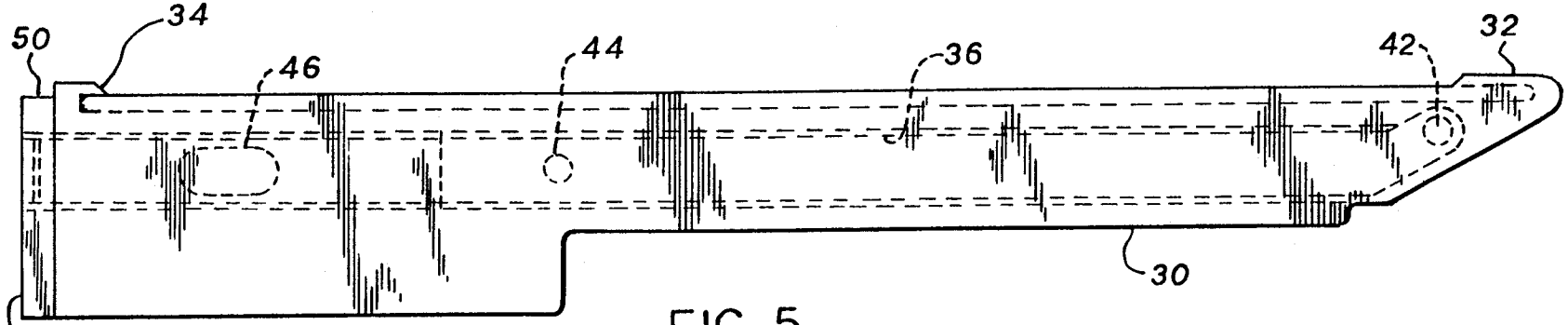
FIG. 5 is a view taken on line 5—5 of FIG. 4 showing the outside of the side wall bracket.

More particularly, and referring to FIGS. 3 through 5, one of the side wall brackets 22 is shown. The other bracket 24 is a mirror image of the bracket 22. Each bracket includes a molded side wall 30 having a retainer 32 at the front end and a retainer 34 at the back end to engage the front and back edges of the glass panel 26.

A recess 36 is provided on the inside surface of each of the brackets 22, 24. The conductive strip 38 is aligned in the recess 36 and retained therein by means of pins 42 and 44. The pin 42 is provided at the front of the bracket and pin 44 is spaced inwardly from the back end of the bracket. The back wall 16 is powder coated throughout the exposed surfaces with the inner wall 20. The formed tabs 40 provide electrical contact with the inner wall 20. It should be noted that rearward of the pin 44 the surface 48 of the recess 36 is beveled rearwardly and outwardly from pin 44 to the end of the bracket. The beveled surface 48 allows the formed tab 40 at the end of strip 38 to move outwardly on engagement with the edge of the back wall. The formed end 40 can then be snapped into one of the slots 18 due to the inherent bias of the strip 38.

Referring to FIG. 6, an enlarged view is shown of the engagement of the formed end 40 of the metallic strip 38 with one of the slots 18 in the inner wall 21 of steel standard 20. The beveled surface 48 in the bracket allows the formed end 40 in the strip to be disengaged from the slots 18 by pressing a button 46 provided on the strip 38 against the beveled surface 48 to clear the formed end 40 from the slot 18 in the inner wall 21.

Means are provided for moving the formed end 40 out of the slot when the shelf is moved upwardly on the back wall. In this regard and referring to FIG. 7 the formed end 40 is shown with a 45° beveled edge 45. When the bracket 24 is moved upward the beveled edge 45 will engage the upper edge of the slot 18 in the standard camming the formed end 40 outwardly toward the beveled surface 48 so that the formed end 40 will clear the slot as the shelf is moved upward to a new location.

The brackets 22 and 24 are guided into the recesses 14 in the back wall by tabs or guides 50 and 52 located on the end of each bracket. The guides 50 and 52 maintain the alignment of the bracket in the recesses on each side of the back wall, thereby preventing cocking or tilting of the shelf as the shelf is moved upward in the recesses 14 in the back wall of the refrigerator.

Referring to FIG. 8, a cross-sectional view is shown of the light assembly 25. In this regard the light assembly includes an aluminum extrusion 54 having a groove 56 for aligning the extrusion on the front edge of the glass panel 26. The extrusion is provided with a recess 58 which is undercut at 60 at the top of both the front and the back of the recess. Plastic blocks 64 having guides 67 and an opening 70 are provided in each end of the recess 58 with guides 67 aligned with the undercuts 60. One or more low voltage sockets 62 having guides 67 on each side are inserted into the recess 58 with the guides 65 aligned with the undercuts 60. A diffuser 66 is pivotally mounted on a pin 68 to enclose the slot 58. The diffuser 66 snaps to a closed position in a groove 76 in the extrusion. The brackets 22 and 24 are secured to the extrusion by inserting the pin 42 into the opening 70 in plastic blocks 64. The pins 42 are electrically connected to the sockets 62 by electric wires 72 located in groove 74 in extrusion 54.

Thus, it should be apparent that there has been provided in accordance with the present invention an adjustable illuminated refrigerator shelf that fully satisfies the objectives and advantages set forth above. Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

The embodiments of the invention in which an exclusive property or privilege is claimed are defined as follows:

1. In a refrigerator having a cabinet and a back wall having vertical standards forming recesses on each side of the back wall, a number of slots in each of said standards and an adjustable shelf assembly adapted to be mounted on the back wall, said shelf assembly comprising:
   - a pair of brackets mounted on the standards in the back wall,
   - an electrically conductive strip mounted on each of said brackets,
   - each strip including a formed tab at one end for engaging one of the slots in each of the recesses,
   - a panel supported by said brackets to form a shelf in the cabinet and a light assembly mounted on the front edge of said panel.

2. The shelf assembly according to claim 1 wherein said back wall and strip are formed from electrically conductive material and means for electrically connecting said light assembly to said strip.

3. The shelf according to claim 2 wherein said light assembly includes, a housing mounted on the front edge of said panel, a number of light assemblies mounted in said housing, and a diffuser pivotally connected to said housing for providing access to said light assemblies.

4. The shelf assembly according to claim 1 wherein said formed tabs are beveled at the top for camming said tabs out of said slots when said brackets are moved upwardly in said recesses.

5. The shelf assembly according to claim 1 wherein said brackets include a guide at the end of said bracket for aligning said brackets in said recesses.

6. An apparatus for lighting the interior of a refrigerator cabinet, said apparatus comprising a back wall mounted in said cabinet,
   - a standard mounted on each side of the back wall to form a vertical recess on each side of said back wall,
   - each standard including a number of openings in the inner wall,
   - a shelf assembly including a pair of brackets,
   - each of said brackets including a guide for aligning said brackets in said recesses,
   - a shelf supported by said brackets,
   - means mounted on the front of said shelf for illuminating the area below said shelf, and
   - means mounted on said brackets for electrically connecting said illuminating means to said standards.

7. The apparatus according to claim 6 wherein said electrically connecting means includes an electrically conductive strip mounted on each of said brackets.

8. The apparatus according to claim 7 wherein said connecting means includes a formed tab at one end for releasably engaging the openings in the standard.

9. The apparatus according to claim 6 wherein said illuminating means includes a housing, a number of light assemblies mounted in said housing, said electrical connecting means including a conductive strip for connecting said light assemblies to said standards.

* * * * *